United States Patent [19]

Burckel, deceased

[11] 4,198,494

[45] Apr. 15, 1980

[54] INTIMATE FIBER BLEND OF POLY(M-PHENYLENE ISOPHTHALAMIDE) AND POLY(P-PHENYLENE TEREPHTHALAMIDE)

[75] Inventor: William G. Burckel, deceased, late of Wilmington, Del., by Velma B. Burckel, executrix

[73] Assignee: E. I. Du Pont de Nemours and Company, Wilmington, Del.

[21] Appl. No.: 511,028

[22] Filed: Sep. 30, 1974

[51] Int. Cl.[2] ..... C08L 77/00

[52] U.S. Cl. ..... 525/432; 57/255; 162/142; 428/359; 525/142; 525/143; 525/178; 525/425

[58] Field of Search ..... 260/857 TW; 162/142; 57/140 BY, 255; 428/359

[56] References Cited

U.S. PATENT DOCUMENTS

| | | | |
|---|---|---|---|
| 3,090,103 | 5/1963 | Crawley | 28/78 |
| 3,125,404 | 3/1964 | Crawley | 8/115.7 |
| 3,359,717 | 12/1967 | Marzocchi et al. | 57/140 |
| 3,591,673 | 7/1971 | Pollack | 260/857 TW |
| 3,600,350 | 8/1971 | Kwolek | 260/857 TW |
| 3,620,003 | 11/1971 | Chopra | 57/140 BY |
| 3,628,995 | 12/1971 | Economy | 117/138.8 G |
| 3,652,510 | 3/1972 | Blomberg | 260/857 TW |
| 3,855,047 | 12/1974 | Groff | 57/140 BY |

*Primary Examiner*—Paul Lieberman

[57] ABSTRACT

This invention relates to fiber blends, yarns and fabrics for use in lightweight garments offering protection against brief exposure to extreme thermal fluxes, the fiber blend comprising a component that fuses within 10 seconds upon exposure to a heat flux of 2 cal./cm.$^2$/sec. and a component that in fabric form exhibits a flame strength of at least 20 mg. per denier for at least 10 seconds during exposure to a heat flux of 2 cal./cm.$^2$/-sec.

3 Claims, 1 Drawing Figure

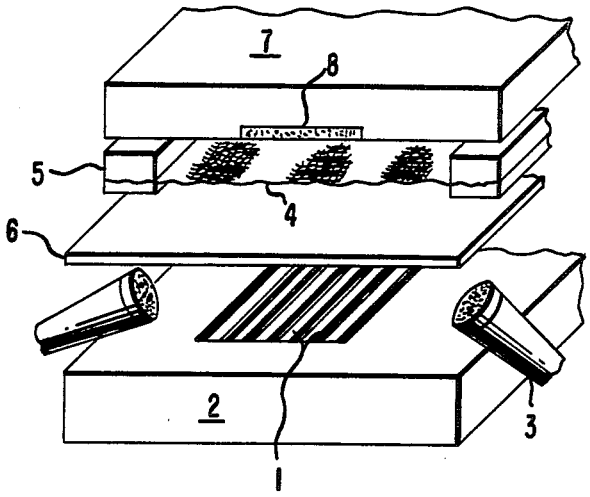
7
8
5
4
6
2
3
1

INTIMATE FIBER BLEND OF POLY(M-PHENYLENE ISOPHTHALAMIDE) AND POLY(P-PHENYLENE TEREPHTHALAMIDE)

BACKGROUND OF THE INVENTION

Aviators, race drivers, foundry workers, etc. are occasionally exposed to intense heat fluxes when they are involved in accidents which result in fires, e.g., flaming fuel. In such events, survival is often possible, if protection from the intense thermal flux can be provided at least long enough to allow escape from the immediate site of the accident, e.g., for about 10 seconds or longer. In order for protective clothing to be able to provide such protection, it is not sufficient that the fabric merely be flame resistant—the fabric must also maintain sufficient strength while immersed in the intense thermal flux that the garment will not break open and allow direct exposure of the wearer's skin to the flames. To be completely acceptable, the fabric must also be lightweight, conformable, nonscratchy, durable in normal use, dyeable, etc. in order that the protective garments made therefrom will be sufficiently comfortable and aesthetically attractive that they will be readily accepted for routine wear, so that they will be "in place" should a catastrophe occur.

THE PRIOR ART

Many types of flame resistant fabrics, i.e., fabrics which are self-extinguishing when the ignition source is removed, have been provided by the prior art. For example, fabrics of normally flammable fibers, e.g., cotton, rayon, etc. have been treated with innumerable flame resistant surface coating compositions. More recently, flame resistant fabrics have been prepared from either normally flammable synthetic fibers, e.g., rayon, polyolefins, polyesters, acrylics, etc., which have been spun with flame retardant additives or from other synthetic fibers which are spun from polymers which are inherently flame resistant, e.g., polyvinylchloride, polytetrafluoroethylene, polymetaphenyleneisophthalamide (hereinafter MPD-I). Although such flame resistant fabrics have found substantial application in carpets, draperies, upholstery, etc. and also in garments such as costumes, sleepwear, etc. where flame propagation from inadvertently applied ignition sources is to be avoided, in general such fabrics are not satisfactory for the present protective garments since they exhibit high shrinkage or rapid break open on exposure to intense heat fluxes. For such extreme exposure situations, the prior art has provided predominately fabrics prepared from inorganic fibrous materials, e.g., asbestos, fiber glass, and various ceramic materials, such as aluminum silicate. Though functional to various degrees, such fabrics are not fully satisfactory; the inorganic fibrous materials tend to be brittle, leading to substantial difficulties in fabricating yarns and fabrics therefrom, to rapid loss of strength in use due to fiber fracture on flexing and even to loss of fiber content on repeated washing, and to wearer discomfort from pricking and sticking by the stiff protruding broken fiber ends. Additional negatives include gross fabric weights (10 oz./yd.$^2$ and up), poor drape and conformability, nondyeability, and unacceptability on ecological grounds. Very recently, the art has provided a limited number of super-high-temperature organic polymeric fibers, e.g., polybenzimidazoles, polyoxadiazoles, polyparaphenylene terephthalamide (hereinafter PPD-T) and certain heat-treated/cyclized acrylics, which in fabric form can survive intense thermal fluxes, at least for a worthwhile interval. However, such fabrics also exhibit one or more negatives, such as limited durability (poor abrasion resistance, low flex life) and poor dyeability. In some instances the polymer used for the fiber of the fabric is inherently highly colored or difficultly spinnable.

SUMMARY OF THE INVENTION

An intimate, synergistic blend of organic staple fiber components that preferably exhibits a limiting oxygen index (L.O.I.) of at least 26.5 in fabric form and comprises at least about 15% by weight of a first fiber component (referred to below as the "A" component) which in fabric form will meld or fuse within 10 seconds during exposure to a heat flux of 2 cal./cm.$^2$/sec. and from about 3 to 20% by weight of a second fiber component (referred to below as the "B" component) which in fabric form exhibits a flame strength of at least 20 mg. per denier for at least 10 seconds, during exposure to a heat flux of 2 cal./cm.$^2$/sec. The blend in the form of yarn is suitable for use in the fabrication of lightweight garments affording protection against brief exposure to extreme thermal fluxes. Also encompassed is yarn from such blend and fabric woven therefrom.

DETAILED DESCRIPTION OF THE INVENTION

"Organic fiber" means a natural or synthetic organic fiber which may contain minor quantities of various additives.

"Staple" refers to short lengths, e.g., ½ inch to 10 inches, of normal textile denier fibers, e.g., ½–10 dpf, suitable for processing by conventional textile operations, e.g., carding, spinning, weaving, etc. The most preferred staple will have a denier less than two dpf in order that fabrics produced from such blends will be rated "comfortable". The staple fibers preferably are crimped.

"Intimate blend" means that the individual staple components are not preferentially segregated within any particular region of the blend, beyond the normal fluctuation in distribution expected on a purely statistical basis. The blend may be in the form of a bale, a sliver, a yarn, a nonwoven, woven, or knitted fabric, etc. The fabrics are preferably "lightweight", i.e., have a basis weight of 3–10 oz./yd.$^2$. Intimate blends of the required proportions of the desired staple components may be prepared by various conventional textile blending techniques, e.g., cofeeding tows of A and B fibers to a staple cutter; opening and air-mixing A and B staple bales; combining slivers of A and B staple prior to drafting, etc.

An "A" fiber component is one which in fabric form (100% A) will exhibit extensive inter-fiber fusion or melding as shown by microscopic examination, upon exposure to a heat flux of 2 cal./cm.$^2$/sec. for 10 seconds as in a modified flame test. Fabrics of 100% A fiber will normally break open during the high-temperature exposure, in which case, the examination will be conducted in the peripheral regions surrounding the break. Examples of A components include modacrylic, acrylic, polyester and MPD-I fibers. Preferably A components should be selected which in combination with the B fiber component yield L.O.I. values of at least 26.5 measured in fabric form.

A "B" fiber component is one which in plain woven fabric form (100% B approximately 5 oz./yd.$^2$ basis weight) will exhibit a minimum flame strength of 20 mg./denier for at least 10 seconds. In this test, a one inch wide strip of the test fabric is suspended at its upper end from a rod while the lower end supports a known weight. The rod is mounted parallel to the top edge of a vertically disposed 8 inch×8 inch stainless steel plate in whose center is cut a 2½ inch high by one inch wide aperture. The top and bottom sections of the plate are bent forward very slightly in order that the fabric test strip, hanging behind the plate and aligned with the aperture, will lean against the plate and be disposed approximately flush with the front surface of the plate within the aperture region. To commence a test, the plate and test sample assembly is swung rapidly into place such that the fabric is abruptly exposed through the aperture to a precalibrated heat flux of 2 cal./cm.$^2$/-sec. provided by the flame from a Meker burner, mounted at about 45° to the vertical, and fueled by propane gas. Successive strips of fabric are thus exposed, supporting larger or smaller weights, until the maximum load is determined which the fabric will support during 10 seconds exposure in flame. This load (in mgs.) is divided by the total denier of all the yarns running in the fabric vertical (test) direction in order to compute the flame strength of the fabric in mgs./denier. To determine whether a fiber qualifies as an A component, a fabric of the fiber may be subjected to this test, however, no load need be applied. After 10 seconds exposure the fabric is examined for inter-fiber fusion.

The requirement that B component candidates in fabric form exhibit minimum flame strength of 20 mg./denier for at least 10 seconds serves to insure that even at concentrations of 20% and less, the B component can contribute sufficient "reinforcement" to the blend to prevent fabric break open. (A fabric flame strength of approximately 2 mg./denier appears to be sufficient to insure against fabric break open.) Examples of B components include PPD-T, poly(p-benzamide), phenolic resin, polybenzimidazole and carbon fibers.

The 2 cal./cm.$^2$/sec. heat flux is an average "intense heat flux"; measured values ranging from about 1.5–2.6 cal./cm.$^2$/sec. being characteristic of the extreme heat fluxes associated with fuel oil conflagrations. For testing purposes in the laboratory the required heat flux may conveniently be obtained with a Meker burner, fueled with propane gas, and adjusted to provide the desired flux as indicated by a conventional slug calorimeter, or by various commercial instruments, such as the "Asymptotic" calorimeter available from Hy-Cal Engineering.

"Synergistic" is employed in the sense that the strength of a fabric prepared from the present blends is significantly (often many-fold) higher than the sum of the strength contributions from the individual components (as shown in Example I), all determined under 2 cal./cm.$^2$/sec. heat flux (abbreviated below "in flame").

The Fabric Break Open Test is performed using apparatus schematically shown in the Figure. The heat flux is supplied by combined radiant and convective sources. The radiant energy is supplied by nine quartz infrared tubes (1) (e.g., General Electric Co., Type T-3, 500 watts, each) to which a total of up to 45 amperes current is supplied from a power supply not shown. These tubes are located within a box (2), of ¼ inch thick Transite, whose top is a water cooled ⅜–7/16 inch thick stainless steel jacket. Radiant energy from the quartz tubes is directed upward toward the fabric sample through a four inch×four inch opening in the top of the box. Convective energy is supplied by two Meker burners (3) positioned (on opposite sides) over the top of Transite box (2), each at an angle of about 45° from horizontal. The tops of the Meker burners are separated from each other by a distance of about 5 inches. In order to insure a constant gas flow rate, gas is fed to the burners through a flow meter from the fuel supply. The gas flow to these burners can be shut off by a toggle switch.

The test fabric sample (4) held in holder (5) can be brought into horizontal position above the heat flux provided by the tubes and burners by means of a carriage, not shown. When the sample is in this position, it is about 2¼ inches above the tops of the burners and about 3¾ inches above the infrared tubes. A 4 inch by 4 inch area of the fabric test sample is exposed to the heat flux unless otherwise indicated.

Located in a fixed position above the tubes and burners but below the "test position" plane of the fabric sample is a movable, water-cooled steel shutter (6). When located in the "closed position", i.e., directly above the heat flux, the shutter insulates the fabric test sample from the heat flux. When the shutter is removed from above the heat flux, the "open positon", the fabric sample is exposed to the heat flux. The duration of the fabric exposure to the heat flux can be controlled by movement of the shutter into or out of "closed position".

The top member of the apparatus shown is an insulating (Marinite) block (7) containing a copper slug calorimeter (8) whose output is fed to an appropriate recording apparatus, not shown, by which the temperature rise (° F.) experienced by the calorimeter can be recorded on chart paper. The distance between calorimeter (8) and the top surface of a fabric sample (4) is ¼ inch.

For the Fabric Break Open Test, the heat flux is a combination of radiant and convective energy in about a 50/50 ratio; the total heat flux to which each fabric sample is subjected is 2 calories/cm.$^2$/sec. In each test the quartz tubes and Meker burners are at operating temperatures and the shutter is in the "closed" position prior to exposure of the fabric sample which has been placed on the carriage in the "test" position. The fabric sample is held taut in the holder, the shutter is opened, and the time required for the heat flux to cause a hole to form in the fabric is measured by an observer with a stopwatch.

The use of the fiber blend in staple form is particularly important for the required aesthetics mentioned above. It was not obvious that break-open resistance could be achieved with the staple fiber blend fabric of the invention.

The lower limit of the 3–20 weight % range for the total B component in the blends is considered to be a practical minimum level to insure uniform distribution of the B component throughout the blends. While blends containing more than 20% B component do exhibit high strength in flame and do not break open, the "synergistic" strength effect is much less striking. Finally, it is highly desirable to use the minimum effective proportion of the B component since B fibers are either difficult to dye or inherently highly colored and high B content usually contributes to undesirable fabric aesthetics, poor abrasion resistance, low flex life, and poorer economics.

The 15% minimum A component content is required to furnish enough "glue" for the blend to exhibit the synergistic strength effect. When no third component is present, the A component content can of course rise to a maximum of 97%, i.e., when B is present at the 3% minimum level.

The requirement that L.O.I. for the blend be at least 26.5 insures that the protective garment will not continue to burn when the ignition source is removed (reference, L. Benisek, Tex. Chem. & Colorist, Vol. 6, No. 2, 1974 (pages 25–29).

EXAMPLE I

A set of fiber blends is prepared with various proportions of A and B components.

The A component is selected to be crimped crystalline MPD-I fibers of 1.5 inches length and 1.5 dpf. A fabric prepared exclusively from such fiber breaks open on exposure to 2 cal./cm.$^2$/sec. at 2.8 seconds, and the peripheral areas around the break on subsequent examination, exhibit extensive fiber fusion or melding.

The B component is selected to be crimped staple textile fibers of PPD-T of 1.5 inches length and 1.25 dpf. Though fibers from this aromatic polyamide are inherently flame resistant, these particular fibers also contain a flame retardant additive providing a phosphorus content of approximately 1% by weight. A fabric prepared exclusively from these fibers exhibits a flame strength of 126 mg./denier.

Slivers of each of these staple components are blended in various proportions on a draw frame to provide 37's two-ply c.c. yarns which are woven into plain weave fabrics, 64×44 in the loom, having basis weights in the range of 4.2–4.6 oz./yd.$^2$. Fabric flame strengths and break open times are shown in Table IA. These data indicate that even with as little as 5 weight % B fibers, the strength in flame for the blended fabrics has risen high enough to prevent fabric break open for periods in excess of one minute, i.e., well in excess of the 10 seconds minimum objective. All of these blended fabrics have L.O.I. values greater than 26.5, i.e., are self-extinguishing in air.

Table IA

| Composition (%A/%B) | Flame Strength (mg./den.) | Break-Open Time (sec.) |
|---|---|---|
| 100/0 | 0.3 | 2.8 |
| 95/5 | 3.7 | >60 |
| 90/10 | 7.5 | >60 |
| 80/20 | 12.9 | >60 |
| 65/35 | 46.0 | >60 |
| 0/100 | 126.0 | >60 |

Portions of each of the blended fabrics are immersed at room temperature in dimethylacetamide containing 3% lithium chloride to selectively remove (dissolve away) the A component fibers. The fabric "residues", consisting of the B component only, are tested for strength in flame, and the data reported in Table IB. Inspection of the results reveals that only for compositions greater than 20% B is any appreciable strength developed, in the absence of the A component. The 20-fold and greater increases in strength exhibited by the blends at B concentrations of 20% and lower (i.e., in the range of the present invention) is a result of a synergistic interaction between the two components, since the A component alone is clearly incapable of providing such strengths.

Table IB

| Composition (%A/%B) | Flame Strength (mg./den.) | |
|---|---|---|
| | Blend Fabric | B "Residue" Fabric |
| 100/0 | 0.3 | — |
| 95/5 | 3.7 | <0.1 |
| 90/10 | 7.5 | 0.3 |
| 80/20 | 12.9 | 0.6 |
| 65/35 | 46.0 | 26.5 |
| 0/100 | 126.0 | 126.0 |

EXAMPLE II

An intimate blend according to the present invention is prepared from 90% A and 10% B components where A is selected to be 1.5 dpf, 1.5 inch crimped staple fibers of amorphous MPD-I, and B is selected to be 1.5 dpf, 1.5 inch crimped high modulus staple fibers of PPD-T. The blend is spun into yarn which is woven into fabrics of various construction (two plain weave and two twills) of basis weights from 4 oz./yd.$^2$ up to 6½ oz./yd.$^2$. All of these fabrics survive the break-open test for well over 10 seconds, and their flame strengths are observed to be substantially independent of fabric type and basis weight (7.5±10% mg./den.).

One of these fabrics is subsequently retested after being subjected to a dyeing step, again after a further calendering step, and still again after a final autoclaving step. The measured flame strength is invariant to all these fabric processing steps, and thereby appears to be a function of the blended composition only (although there is some indication from other data that flame strength values for certain blends can be influenced by preconditioning the test fabrics at various humidities).

The blend of this example has several attractive features beyond its superior intense heat flux resistance: the blend processes well through all normal textile operations (carding, spinning, weaving, etc.), the fabrics therefrom are dyeable in practically unlimited range of colors, and the aesthetics of the finished fabrics are most attractive, including excellent hand, good crease retention, etc.

EXAMPLE III

Additional intimate blends according to the present invention are prepared from various other choices for components A and B, as indicated in Table II. The blends are spun into yarn and woven into fabric. Inspection of the data readily reveals that the fabrics having 100% A compositions have low flame strength, and break open within 10 seconds on high flux exposure (and the samples show extensive inter-fiber fusion). Fabrics from the B components have flame strength in excess of 20 mg./den. The blends of Items 1–6 all exhibit appreciable strength in flame, and exhibit break-open times in excess of 10 seconds. While fabrics of the blends of Items 1–4 all have L.O.I. values greater than 26.5 and are preferred, those of Items 5 and 6 have L.O.I. values less than 26.5 and are less preferred.

TABLE II

| Item | A Staple Component | B Staple Component | %A/%B | Flame Strength (mg./den.) | Break Open Time (Sec.) |
|---|---|---|---|---|---|
| 1 | Amorphous MPD-I | PPD-T (high modulus) | 100/0 | 0.3 | 4.7 |
| | | | 95/5 | 14.4 | >30 |

TABLE II-continued

| Item | A Staple Component | B Staple Component | %A/%B | Flame Strength (mg./den.) | Break Open Time (Sec.) |
|---|---|---|---|---|---|
| | | | 90/10 | 31.6 | >30 |
| 2 | " | PPD-T (textile) | 95/5 | 12.3 | >30 |
| | | | 90/10 | 31.2 | — |
| 3 | Crystalline MPD-I | Polyparaaminobenzoic acid | 97/3 | 1.6 | >60 |
| | | | 95/5 | 2.2 | >60 |
| | | | 90/10 | 2.7 | >60 |
| | | | 80/20 | 3.4 | >60 |
| | | | 0/100 | >34.0 | >60 |
| 4 | Modacrylic (Monsanto's SEF fire retarded fiber) | PPD-T (textile) | 100/0 | 0.1 | 1.8 |
| | | | 95/5 | 4.6 | >30 |
| | | | 90/10 | 6.0 | >30 |
| 5 | Acrylic (Du Pont's Type 775 F Orlon® fire retarded acrylic) | PPD-T (textile) | 100/0 | 0 | 1.5 |
| | | | 90/10 | 6.5 | 7, >30, >30 |
| 6 | Polyester (Du Pont's Type 900 F Dacron® fire retarded polyester | PPD-T (textile) | 100/0 | 0 | 1.3 |
| | | | 95/5 | 2.8 | 4–28* |
| | | | 90/10 | 7.7 | 27–36* |

*Although the fabrics resisted break-open, as indicated, a portion of the A component was "boiled out" of the fabric during the extreme thermal exposure.

EXAMPLE IV

In another experiment similar to Example I, a set of fiber staple blends is prepared with various proportions of A and B components. In this case, the A component is chosen to be modacrylic staple (Monsanto's SEF fire retarded modacrylic) and the B component is selected to be phenolic staple (Carborundums Kynol). Fabrics of 100% SEF fiber break open in flame and show extensive fiber melding. The flame strength and break-open times for the blend fabrics are listed in Table IIIA. Although the flame strength for the 95/5 and 90/10 blends of the present invention are quite "modest" (the Kynol component itself being close to the lower acceptable flame strength limit for B components), the fabrics do survive the break-open test for at least 10 seconds, as required.

TABLE IIIA

| Composition (%A/%B) | Flame Strength (mg./den.) | Break-Open Time (sec.) |
|---|---|---|
| 100/0 | 0.1 | 1.8 |
| 95/5 | 1.3 | >30 |
| 90/10 | 2.0 | >30 |
| 75/25 | 4.4 | >30 |
| 0/100 | 24.0 | >30 |

Again, as in Example I, portions of each of the blended fabrics are immersed in warm dimethylsulfoxide to selectively remove (dissolve away) the A component fibers. Flame strength values for the "residue" fabrics are shown in Table IIIB (the 5% "residue" fabric being too weak to handle). Again, it is obvious on inspection that a synergistic increase in strength is exhibited by these blended fabrics.

TABLE IIIB

| Composition | Flame Strength (mg./den.) | |
|---|---|---|
| (%A / %B) | Blend Fabric | B "Residue" Fabric |
| 100/0 | 0.1 | — |
| 95/5 | 1.3 | — |
| 90/10 | 2.0 | 1.3 |
| 75/25 | 4.4 | 3.1 |
| 0/100 | 24.0 | 24.0 |

EXAMPLE V

This invention is not restricted to blends of only two staple components but comprehends multicomponent blends as well, e.g., employing multiple A and/or B components to attain the required total percentages of each type, as well as in the use of (multiple) "inert" C components in addition to the required percentages of A and B.

(1) Acrylic staple (Du Pont's Type 775 F Orlon® staple) and polyethylene terephthalate staple (Du Pont's Type 900 F Dacron® staple) are each A components. PPD-T textile staple containing a flame retardant additive is a B component. A ternary blend is prepared from these three ingredients in the ratio 45/45/10. Fabric prepared from this blend exhibits a flame strength of only 1.5 mg./den., but does resist break-open for more than 60 seconds, as would have been anticipated. However, the fabric burns in air, i.e., has an L.O.I. less than 26.5, and this particular blend is accordingly not preferred for use in protective garments.

(2) Another ternary blend is prepared from three flame-resistant components as follows: 30% A (MPD-I crystalline)/10% B (PPD-T plus flame retardant additive)/60% C (American Viscose's PFR rayon). Fabric of this blend has a flame strength of 10.9 mg./den. and a break-open time in excess of 60 seconds, as would have been anticipated. (For comparison, a "control" fabric prepared from a 30/70 MPD-I crystalline/American Viscose's PFR rayon blend has a flame strength of only 3.9 mg./den.). However, this particular fabric also surprisingly burns in air, and is accordingly, unsuitable for use in protective garments.

What is claimed is:

1. An intimate blend of organic staple fiber components comprising at least about 15% by weight of a first fiber component consisting of poly(m-phenylene isophthalamide) fibers which in fabric form will meld or fuse within 10 seconds during exposure to a heat flux of 2 cal./cm.$^2$/sec. and from about 3–20% by weight of a second fiber component consisting of poly(p-phenylene terephthalamide) fibers which in fabric form exhibit a flame strength of at least 20 mg./den. for at least 10 seconds during exposure to a heat flux of 2 cal./cm.$^2$/sec.

2. An intimate blend of organic staple fiber components comprising at least about 15% by weight of a first fiber component consisting of poly(m-phenylene isophthalamide) fibers which in fabric form will meld or fuse within 10 seconds during exposure to a heat flux of 2 cal./cm.$^2$/sec. and from about 3–20% by weight of a second fiber component consisting of poly(p-benzamide) fibers which in fabric form exhibit a flame strength of at least 20 mg./den. for at least 10 seconds during exposure to a heat flux of 2 cal./cm.$^2$/sec.

3. The fiber blend of claim 1 wherein the poly (m-phenylene isophthalamide) fibers are amorphous.

* * * * *